US008080116B2

(12) United States Patent
Pfeifenbring et al.

(10) Patent No.: US 8,080,116 B2
(45) Date of Patent: Dec. 20, 2011

(54) METHOD FOR PRODUCING A COOLING ELEMENT

(75) Inventors: Karlfried Pfeifenbring, Norden-Suderneuland (DE); Marcus Hering, Siegen (DE); Peter H. Müller, Freudenberg (DE)

(73) Assignee: Hundt & Weber GmbH, Siegen (DE)

( * ) Notice: Subject to any disclaimer, the term of this patent is extended or adjusted under 35 U.S.C. 154(b) by 1347 days.

(21) Appl. No.: 10/539,965

(22) PCT Filed: Dec. 8, 2003

(86) PCT No.: PCT/DE03/04030
§ 371 (c)(1),
(2), (4) Date: Sep. 8, 2006

(87) PCT Pub. No.: WO2004/057256
PCT Pub. Date: Jul. 8, 2004

(65) Prior Publication Data

US 2007/0000579 A1 Jan. 4, 2007

(30) Foreign Application Priority Data

Dec. 20, 2002 (DE) ..... 102 59 870

(51) Int. Cl.
*C21D 9/00* (2006.01)
*C21D 9/08* (2006.01)
*C23C 6/00* (2006.01)

(52) U.S. Cl. ..... 148/519; 148/518; 148/522; 164/91; 266/193

(58) Field of Classification Search ..... 428/674, 428/675, 680, 34.1, 304.4, 586, 593, 615; 164/47, 69.1, 75, 76.1, 91, 138; 266/193, 266/241, 46, 190; 148/518, 519, 522
See application file for complete search history.

(56) References Cited

U.S. PATENT DOCUMENTS 5,441,763 A * 8/1995 Kuo ..... 427/195
5,904,893 A 5/1999 Stein
6,280,681 B1 8/2001 MacRae
6,773,658 B1 * 8/2004 Leppanen et al. ..... 266/44

FOREIGN PATENT DOCUMENTS

DE 726599 10/1942

(Continued)

OTHER PUBLICATIONS

International Search Report published May 7, 2004 and issued by the European Patent Office in connection with International Appln. No. PCT/DE 03/04030.

*Primary Examiner* — Michael Lavilla
(74) *Attorney, Agent, or Firm* — Lucas & Mercanti, LLP; Klaus P. Stoffel

(57) ABSTRACT

The invention relates to a cooling element, particularly for use in walls of furnaces that are subjected to high levels of thermal stress, and to a method for producing a cooling element. The cooling element is comprised of cast copper or of a low-alloyed copper alloy and is provided with coolant channels, which consist of tubes cast inside the copper or the copper alloy and which are placed inside the cooling element. In order to create a cooling element with an improved material bond on the contact surfaces between the cooling tube and the metal cast around it and thus with an increased heat transfer, the invention provides that the tubes of the coolant channels are provided with an electrolytic coating on the exterior thereof. The use of copper tubes has been shown to be particularly advantageous, and the coating of the tube exteriors thereof ensues in an electroplating bath.

8 Claims, 1 Drawing Sheet

FOREIGN PATENT DOCUMENTS

| | | | |
|---|---|---|---|
| EP | 0 816 515 | A1 | 1/1998 |
| EP | 1 136 573 | A1 | 9/2001 |
| GB | 1 386 645 | | 3/1975 |
| JP | 58-147504 | | 9/1983 |
| RU | 2 100 728 | C1 | 12/1997 |

* cited by examiner

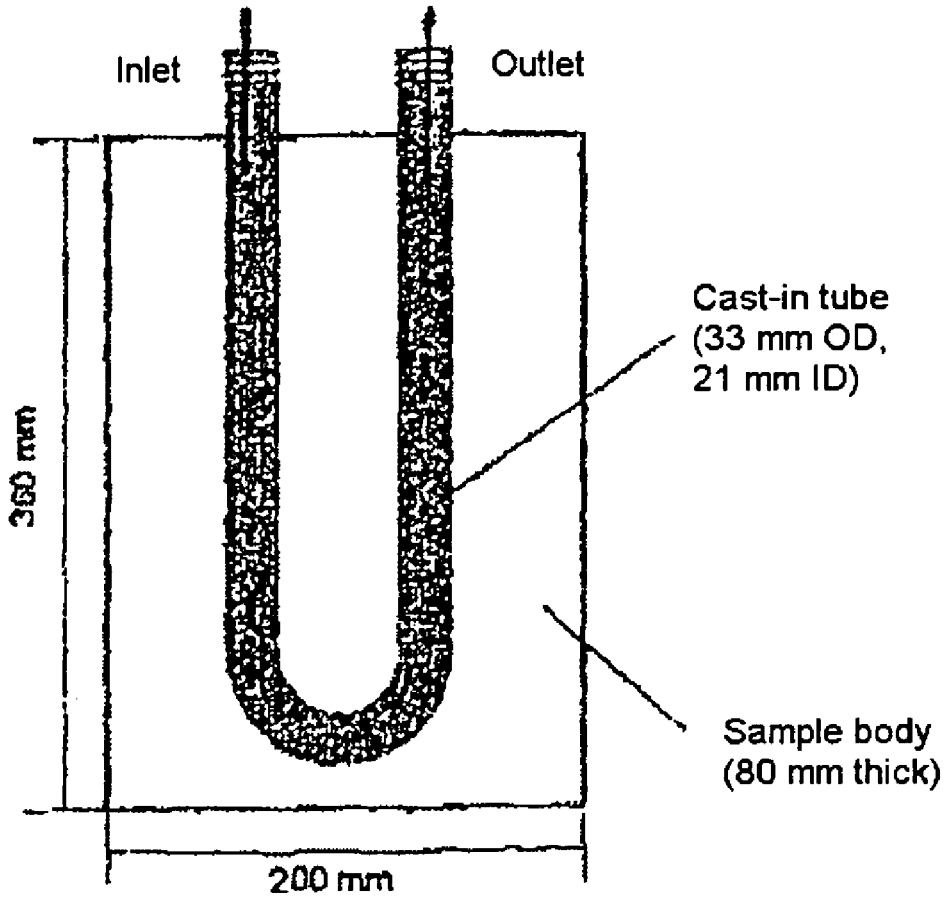
Fig.

METHOD FOR PRODUCING A COOLING ELEMENT

BACKGROUND OF THE INVENTION

The invention relates to a cooling element, in particular for use in walls of furnaces that are subjected to high levels of thermal stress, consisting of cast copper or a low-alloyed copper alloy, with coolant channels which comprise tubes cast in the copper or the copper alloy and are arranged inside the said cooling element.

The invention also relates to a method for producing a cooling element provided inside with coolant channels formed from tubes, in particular for use in walls of furnaces that are subjected to high levels of thermal stress, with the steps of a) fabricating the tube, including all desired curves, branches and similar flow structures,
b) casting molten copper or copper alloy around the tubes within a casting mold, with preferably simultaneous cooling of the inner walls of the tubes,
c) cooling the copper melt.

Such cooling elements are usually arranged between the casing and the lining of a furnace, often also for use behind the refractory lining, for which purpose the cooling elements are connected to the cooling system of the furnace, for example a pyrometallurgical smelting furnace. The surfaces of these cooling elements may, as described for example in EP 0 816 515 A1, be provided on the side facing the interior of the furnace with additional webs or grooves or honeycomb-shaped depressions, in order in this way to permit a better bond with the refractory lining of the furnace or to ensure good adhesion of the slag or metal that is produced by the process in the furnace and solidifies on account of intensive cooling by the cooling elements, as a protection for the cooling element against chemical attack and against erosion. The cooling elements are usually used in the form of cooling plates in the region of the furnace walls or the roof or the hearth region of cylindrical or oval kilns. Such cooling elements are similarly used for pig-iron blast furnaces, in electric arc furnaces, direct reduction reactors and fusion gasifiers. Further areas for use of the cooling elements are burner blocks, tuyeres, casting cavities, electrode clamps, tapping-hole blocks, hearth anodes or dies for anode molds.

The aim in principle with the cooling elements is to achieve a high degree of heat dissipation, whereby both the lifetime of the cooling elements can be improved and peak thermal loads of the process in the furnace, in particular in dynamic operation, which lead to destruction of the cooling element, can be avoided.

In the case of cooling elements with cast-around tubes as coolant channels, the aim is not only for good flow guidance, as free from loss as possible, but also for good heat transfer from the cast metal of the cooling element to the cooling fluid flowing in the tubes. The already cited EP 0 816 515 A1 proposes for this purpose achieving an improved bond between the tube and the casting compound by making part of the thick-walled copper tubes begin to melt when the liquid copper is cast around them, which however entails considerable process-engineering difficulties, since the tube and the melt have the same melting point because they are made of essentially the same material. In the case of relatively cold casting, there is the risk of the tube not fusing adequately with the poured-in metal. This has the consequence of a very great heat transfer resistance between the tube and the cast-around metal. If, conversely, the casting temperature is increased, localized dissolution and melting-through of the tubes, or at least indentation of the cross section of the tubes, is scarcely avoidable, even if thick-walled tubes are used. A composite cast body produced like this is unusable in a furnace.

When copper melts are used, metallurgical dependencies also play an important part. Copper melts tend to absorb gases. In the casting process, disturbing effects are caused in particular by hydrogen and oxygen. The duration of the melting time, and possibly the overheating temperature, likewise play a part and may vary from melting process to melting process. Hydrogen and oxygen are in equilibrium with each other, for which reason high oxygen contents are accompanied by low hydrogen contents and vice versa. Because the solubility of hydrogen in solid copper is much less than in liquid copper, it can be followed from this that the solubility for hydrogen significantly decreases as the temperature falls. At the transition from the liquid phase into the solid phase of the copper melt, an extremely great reduction in the solubility for hydrogen takes effect, generally being referred to as a sudden drop in solubility when the temperature falls below the liquidus temperature, amounting to about 3.5 ml of oxygen per 100 g of copper melt.

The temperature and the pressure also play a major part in determining the absorbency of a melt for gases. The casting of a hydrogen-containing copper melt in the presence of oxygen on the tube surface in the form of copper oxide is problematical, since the oxygen in the atmosphere permeates the melt during the casting on account of the extremely rapid heating up of the tube. On account of the sudden drop in solubility at the transition of the melt from its liquid state into the solid state, the hydrogen set free reacts with the copper oxide in that the latter is reduced and the water vapor produced causes a gas porosity of the casting. From a process-engineering aspect, this can be counteracted by vacuum degassing, which however involves additional effort. Alternatively, a shifting of the water-oxygen equilibrium in the direction of oxygen can be achieved by deliberate oxygen charging, and with it removal of the hydrogen. Following the oxidizing treatment of the melt, the oxygen content must be deliberately reduced by performing a deoxidizing treatment of the melt in the ladle. On account of this albeit laborious two-stage metallurgical treatment of the copper melt, a reaction with the oxygen of the copper oxide of the cast-around copper tubes can no longer lead to an undesired formation of water vapor and consequently gas bubbles within the melt.

As already described, the contact of a highly heated copper melt with a copper tube arranged in the casting mold causes the copper tube to be mechanically weakened. The tube has the tendency to be indented at those places that are subjected to the load of a higher column of metal. To overcome this difficulty, it is disclosed in DE-C 726 599 to pass gases or liquids under an increased counterpressure through the tubes during the casting, this counterpressure corresponding approximately to the deforming resistance of the tube at the softening temperature. However, even if this method is applied, oxidation of the tube on its outer surfaces cannot be avoided during the casting operation.

Various alternatives for the choice of material of the cast tubes are described in U.S. Pat. No. 6,280,681. Apart from describing the possibilities, but also the limits, of the use of tubes made of steel, high-grade steel and copper, also described is a type of cooling element for which tubes made of a material known commercially as "Monel" are used. This material has a copper content of 31% and a nickel content of 63%. It is also described in this publication that, to achieve a good bond, not only copper tubes can be used but also tubes made of Cu—Ni alloys, such as for example UNS C 71500 with a copper content of 70% and a nickel content of 30%. On account of their higher melting point, these tubes have the advantage of a higher thermal load-bearing capacity during casting and can often also be produced without at the same time passing cooling water through the tubes during and after the casting. With such tubes, the risk of the copper melt breaking through into the interior of the tube can be significantly reduced. To preserve a free tube diameter, the tubes are filled with sand before the casting, in order in this way to maintain the tube cross section and avoid collapsing of the tube. Unfortunately, the said tubes made of Cu—Ni and Ni—Cu alloys have a much poorer thermal conductivity than copper tubes, as a result of which significantly less heat can be dissipated when they are later operated as a cooling element, and thermal overloading can occur in particular in the regions of the furnace wall. Furthermore, alloys of nickel and copper are much more rigid, for which reason they cannot be shaped and bent as well. In critical regions, such as for example tight 180° bends, significantly more welds have to be provided on account of the use of pre-bent bends, thereby increasing the risk of later leakages, quite apart from the higher fabrication costs.

Furthermore, there is the already described risk of increased gas porosities on account of water vapor formation, which likewise makes the quality of the casting deteriorate, restricts the heat removal and thereby reduces the heat conduction, since the gas bubbles in the casting act like insulators. The differing coefficient of thermal expansion of the metals involved is also disadvantageous. Compressive and tensile stresses occur on the tube embedded in the casting mold, which can, depending on the shaping of the tube, lead to a locally poor bond between the tube and the cast-around copper, and consequently in turn to a deterioration in the heat conduction.

The prior art also includes a cooling element such as that described in GB 1 386 645. In the case of this cooling element, the tube to be surrounded by casting is not in the casting mold from the outset, but instead the copper melt for producing the copper block is initially introduced into the casting mold, and then the prefabricated tube is immersed in this melt, the inner walls of the tube at the same time being cooled. For the case in which the tube and the melt consist of different metals, the provision of an additional layer on the outer side of the tube is proposed, this additional layer consisting of a further, third metal, which can for example be electrodeposited on the tube. Which metals are suitable for such purposes remains open.

BRIEF DESCRIPTION OF THE DRAWING

The FIGURE shows a sample body.

SUMMARY AND DESCRIPTION OF THE INVENTION

The invention is based on the object of providing a cooling element, in particular for use in walls of furnaces that are subjected to high levels of thermal stress, which is distinguished by an improved material bond, and consequently increased heat transfer, at the boundary surfaces between the cooling tube and the cast-around metal. Furthermore, it is intended to propose a method by which such a cooling element can be produced.

As a solution to achieve this, it is proposed in the case of a cooling element with the features mentioned at the beginning that the tubes of the coolant channels are provided with an electrolytic coating on their outer side.

As a solution to achieve the part of the object concerning provision of a method suitable for producing such cooling elements, it is proposed in the case of a method with the generic features mentioned at the beginning that in the fabrication of the tubes at least those regions of the outer sides of the tubes around which the copper or copper alloy is later cast are electrolytically coated.

According to the invention, therefore, the tubes that are to be surrounded by casting in the production of the cooling element are previously coated with a suitable metal layer by electrolytic means, this metal layer on the one hand not causing any deterioration, but rather an improvement, in the heat transfer, that is to say having a very good specific heat conduction. On the other hand, the electrodeposited metal layer leads to advantages in the passivation of the outer side of the tube against oxidation influences during casting, and the adhesion between the tube and the cast-around metal is improved as a result of diffusion processes occurring in the boundary region. This permits a direct connection between the metal being cast around the tube and the tube around which it is cast, the heat transfer is greatly improved and the tube body cast in by this means is conducive to a good cooling effect when the cooling element is later used, for example in an industrial furnace.

Of particular advantage in particular are the diffusion processes which occur in the outermost layer of the electrolytic coating, since they come into contact with the poured-in copper melt. These diffusion processes lead to a significantly improved adhesion of the casting metal on the tube, combined with a heat transfer with virtually no loss. Since a thin alloy layer is created at the boundary surface between the electrolytic coating of the tube and the cast-around copper, the connecting surface in this region is virtually corrosion-resistant.

In a preferred refinement of the cooling element according to the invention, it is proposed that the tubes are copper tubes and the coating is an electrodeposited nickel coating. According to the method, this is achieved by the coating of the outer sides of the tubes taking place in an electrolytic nickel bath, the thickness of the layer formed in this way being between 3 and 12 μm, preferably between 6 and 10 μm.

Nickel is distinguished by a relatively good heat conductivity, and nickel also has a density that is comparable to that of copper and a very similar atomic diameter. The melting point of nickel at 1453° C. is significantly higher than the melting point of copper at 1083° C., whereby incipient melting of the electrolytic nickel layer is avoided or delayed when the liquid copper is introduced. It has been found in tests that the high melting point of the nickel protects the electrodeposited nickel layer of the tube against being attacked by the melt in the same way as an additional tube. At the same time, the high thermal energy has the effect that diffusion processes take place between the electrodeposited nickel layer and the cast surrounding of copper, leading to a significantly improved adhesion of the cast surround to the copper tube. The creation of a thin alloy layer at the boundary surface between the tube and the surrounding casting compound makes the connecting surface corrosion-resistant; the complete solubility of the copper for nickel and the approximately equal atomic diameter in particular are positive factors here. After completion of the casting and the solidification of the copper, the nickel of the electrodeposited nickel layer is scarcely detectable in this region. Also having an effect here is the long cooling time after the solidification of the copper until the end of the diffusion processes at about 400° C., which, depending on the size of the cast cooling element, amounts to as much as 4 to 8 hours.

With regard to the thickness of the nickel layer electrodeposited on the outer side of the tube, the optimum appears to be between 6 and 10 μm.

In a further refinement of the method according to the invention, it is proposed that the tubes are coated only after the desired form of tube has been fabricated. That is to say that the production of the tube, including all the desired curves, branches and similar flow structures, takes place first. Only then are the tubes electrolytically nickel-plated on their outer side in an electrolytic bath. If, on the other hand, the copper tube is nickel-plated already before the various deforming processes are carried out, it is found that the nickel layers change considerably on account of the heating in the region of the bends and radii of the tube, for example, and consequently a uniform bond with the metal casting is not obtained later.

With a further refinement of the method according to the invention, it is proposed that the outer sides of the tubes are mechanically blasted before the coating, preferably by blasting with coarse glass granules. Before the electrolytic refinement, strong pickling is required. Furthermore, it is advantageous if the coated outer sides of the tubes are degreased, preferably by cleaning with acetone, before the tubes are surrounded by casting.

The tubes in their finished geometrical form are firstly blasted with coarse glass granules, in order to achieve a surface that is as rough as possible, and consequently has a large surface area, with the result of good precleaning and activation of the tubes. Subsequently, the electrolytic coating of the outer sides of the tubes then takes place in the electrolytic nickel bath. On account of the surface previously activated by pickling, good adhesion of the nickel layer is achieved. When the tubes are subsequently fitted into the molding box of the casting mold, it should be ensured that the surface remains free from grease, cleaning of the tubes with acetone being recommended for this. The pouring of the liquid copper into the casting mold then takes place. With the previously cleaned surface as a base, any oxidation of the tube surfaces can be avoided during the pouring in. A deterioration of the bond is prevented in this way. Even slight oxidation of the nickel surface does not appear to have a noticeable disadvantageous effect with the fusion occurring and the diffusion processes taking place.

The results of tests that have been conducted show that rapid cooling from the liquid state as a result of very intensive cooling of the tubes charged with cooling water is also possible during and after the casting operation. Such intensive cooling normally has disadvantageous effects on the quality of the bond. If electroplated tubes are used, however, tests have shown that castings of good quality can be achieved even when the water passed through the tubes has a strong cooling effect. Therefore, this may be referred to as a robust casting process that is relatively insensitive to variations of the process parameters.

With a further embodiment of the cooling element according to the invention, it is proposed that the tubes are not copper tubes, but copper-nickel tubes with a copper content of 30 to 70% and a nickel content of 20 to 65%, the electrolytic coating being a copper coating.

Correspondingly, a method that is suitable for producing such a cooling element is characterized in that the tubes used are copper-nickel tubes with a copper content of 30 to 70% and a nickel content of 20 to 65%, and in that the coating of the outer sides of the tubes takes place in an electrolytic copper bath.

A typical nickel-copper tube of such a type is commercially known by the name "Monel 400". Its nickel content is 63%, its copper content 31%. This tube is distinguished by a high melting point, which is one reason why it is even possible in some circumstances to dispense with the use of cooling water during the casting process. However, the heat conduction of such a tube made of Monel 400 is significantly poorer than in the case of a copper tube and is, in particular, only about 5% of the heat conduction of the copper tube. Furthermore, the relatively high strength of the Monel tubes leads to extra effort, and consequently extra cost, for the fabrication, and in particular the forming, of the tubes. Its inferior bendability in comparison with copper tubes often makes it necessary to use prefabricated tube bends.

Other copper-nickel tubes that are suitable in principle are the so-called "Monel 450", with a copper content of 66% and a nickel content of 32%, and the material UNS C 71500, with a copper content of 70% and a nickel content of 30%. However, even in the case of these tube materials, the thermal conductivities are significantly poorer than in the case of copper. Tubes made of these materials are therefore preferably used in regions of furnace cooling that are subjected to lower levels of stress.

The advantage of the electrodeposited coating of the outer side of the tube is also evident in the case of such alloy tubes made of copper and nickel, to be precise also with respect to the thermal conductivity.

Examples

In the following Table 1, the results from a total of eleven prepared samples are compiled, comparative samples without electrolytic refinement also having been tested. The testing took place by using infrared heat measurements (thermographic analysis) and subsequent shearing tests:

TABLE 1

| Sample No. | Material | Layer | Coating | Result of x-ray examination |
|---|---|---|---|---|
| 1 | Monel 400 (NiCu 63/31) | Copper-plated | 9 μm | Bond good; poorer in bend |
| 2 | Monel 400 (NiCu 63/31) | Nickel-plated | 9 μm | Bond very poor |
| 3 | Copper | Nickel-plated | 3 μm | Gas bubbles; bond good |
| 4 | Copper | Nickel-plated | 6 μm | No bubbles; bond very good |
| 5 | Copper | Nickel-plated | 9 μm | Very slight bubbles; bond very good |
| 6 | Monel 400 (NiCu 63/31) | Without refinement | — | Extreme gassing |
| 7 | Monel 400 (NiCu 63/31) | Without refinement | — | Moderate gassing |
| 8 | Copper | Without refinement | — | Bond very good |
| 9 | Copper | Without refinement | — | Bond very good; slight bubbles in one region |
| 10 | CuNi (10Fe1Mn) | Without refinement | — | Bond rather poor |
| 11 | CuNi (10Fe1Mn) | Without refinement | — | Bond rather poor |

The best results were therefore produced by samples No. 4 and No. 5, for each of which a copper tube with electrolytic nickel plating was used, the layer thickness being 6 μm in the case of sample No. 4 and 9 μm in the case of sample No. 5. A good bond was also produced by sample No. 3, with a reduced nickel layer of 3 μm. However, the tests conducted in a parallel process using a "Monel 400" tube also produced a very good bond between the tube and the surrounding casting compound; the shearing tests that were conducted only produced poorer results in the region of the tube bend.

The following Table 2 shows the test results of the thermographic examination by heat-image evaluation:

Test Results of the Thermographic Examination (Heat-Image Evaluation)

TABLE 2

Cooling by water at a throughflow rate of 1.8 $m^3$/h and a pressure of 6 bar from about 175–180° Celcius
TEMPERATURES IN ° CELSIUS

| Sample No. | After 10 sec | After 30 sec | After 60 sec | After 120 sec | After 200 sec |
|---|---|---|---|---|---|
| 1 | 168.8 | 159.9 | 143.5 | 116.2 | 89.4 |
| 2 | 173.2 | 167.4 | 157.7 | 131.8 | 100.8 |
| 3 | 165.7 | 145.1 | 124.4 | 92.0 | 64.7 |
| 4 | 165.3 | 144.4 | 122.2 | 88.9 | 62.8 |
| 5 | 163.9 | 143.2 | 119.1 | 86.7 | 59.7 |
| 6 | 176.4 | 172.6 | 167.2 | 155.0 | 123.7 |
| 7 | 174.1 | 169.7 | 163.7 | 152.6 | 135.5 |
| 8 | 166.6 | 158.2 | 133.4 | 103.2 | 71.8 |
| 9 | 168.0 | 157.5 | 141.2 | 110.2 | 79.7 |
| 10 | 177.2 | 171.1 | 172.3 | 165.9 | 144.4 |
| 11 | 179.0 | 176.8 | 172.6 | 159.3 | 125.6 |

The following Table 3 finally gives the results of the shearing tests that were conducted, indicating the shearing strength $\tau$ in N/$mm^2$ for the four material pairings of copper without nickel plating, copper with nickel plating, Monel 400 without a copper layer and Monel 400 with an electrolytic copper layer. The particularly good results obtained by the use of a nickel-plated copper tube and a copper-plated tube of Monel 400 are notable:

TABLE 3

Results of the shearing test in N/$mm^2$
Results given by way of example:

| | | | |
|---|---|---|---|
| Copper | without Ni layer | 4.5 | |
| Copper | with Ni layer | 20.7 | 4–5 times as a result of optimal nickel coating |
| Monel 400 | without Cu layer | 4.8 | |
| Monel 400 | with Cu layer | 27.4 | 5–6 times as a result of optimal copper coating |

The sample body represented in FIG. 1 is based on the sample and shearing results compiled in Tables 1, 2 and 3. The tube has a U-shaped profile as a result of the cast body, with an inlet and an outlet protruding from the cast body. In the tests, tubes with an outside diameter of 33 mm and an inside diameter of 21 mm were used in each case; the dimensions of the cast block were 360 mm/200 mm/80 mm. It is evident from the tube dimensions that the wall thickness of the tubes used in the casting tests was in each case 6 mm.

The sample bodies fabricated in this way were heated in an annealing furnace; during the subsequent cooling with a defined amount of water and a defined pressure, thermographic pictures were taken with an infrared camera.

The invention claimed is:

1. A method for producing a cooling element provided inside with coolant channels formed from tubes, for use in walls of furnaces that are subjected to high levels of thermal stress, with the steps of a) fabricating the tubes as copper tubes, including all desired curves, branches and similar flow structures, b) casting molten copper or copper alloy around the tubes within a casting mold, c) cooling the copper melt, wherein during the fabrication of the tubes at least those regions of the outer sides of the tubes around which the copper or the copper alloy is later cast are electrolytically coated with nickel.

2. The method as claimed in claim 1, wherein the tubes are coated only after the desired form of tube has been fabricated.

3. The method as claimed in claim 1, wherein the outer sides of the tubes are mechanically blasted before the coating.

4. The method as claimed in claim 1, wherein the coated outer sides of the tubes are degreased before the tubes are surrounded by casting.

5. The method as claimed in claim 1, wherein the thickness of the electrodeposited layer is between 3 and 12 μm.

6. The method as claimed in claim 3, wherein the outer sides of the tubes are mechanically blasted with coarse glass granules before the coating.

7. The method as claimed in claim 4, wherein the coated outer sides of the tubes are degreased by cleaning with acetone before the tubes are surrounded by casting.

8. The method as claimed in claim 5, wherein the thickness of the electrodeposited layer is between 6 and 10 μm.

* * * * *